US011378029B2

(12) United States Patent
Denert et al.

(10) Patent No.: US 11,378,029 B2
(45) Date of Patent: Jul. 5, 2022

(54) SYNCHRONISATION METHOD ROBUST TO ENGINE STALLING

(71) Applicant: VITESCO TECHNOLOGIES GMBH, Hannover (DE)

(72) Inventors: Camille Denert, Toulouse (FR); Benjamin Marconato, Toulouse (FR); Nora-Marie Gouzenes, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/280,773

(22) PCT Filed: Sep. 26, 2019

(86) PCT No.: PCT/EP2019/076005
§ 371 (c)(1),
(2) Date: Mar. 26, 2021

(87) PCT Pub. No.: WO2020/064913
PCT Pub. Date: Apr. 2, 2020

(65) Prior Publication Data

US 2021/0340924 A1 Nov. 4, 2021

(30) Foreign Application Priority Data

Sep. 27, 2018 (FR) ..... 1858886

(51) Int. Cl.
*F02D 41/00* (2006.01)

(52) U.S. Cl.
CPC ..... *F02D 41/009* (2013.01); *F02D 41/0097* (2013.01); *F02D 2041/0095* (2013.01); *F02D 2200/101* (2013.01)

(58) Field of Classification Search
CPC ..... F02D 41/009; F02D 41/0097; F02D 2041/0095; F02D 2200/101
See application file for complete search history.

(56) References Cited

U.S. PATENT DOCUMENTS 5,626,108 A 5/1997 Kato et al.
5,715,779 A 2/1998 Kato et al.
(Continued)

FOREIGN PATENT DOCUMENTS

EP 0 733 782 9/1996
WO 2014/082730 6/2014

OTHER PUBLICATIONS

International Search Report for PCT/EP2019/076005 dated Nov. 19, 2019, 6 pages.
(Continued)

*Primary Examiner* — Joseph J Dallo
(74) *Attorney, Agent, or Firm* — Nixon & Vanderhye

(57) ABSTRACT

Disclosed is a method for synchronizing an engine including a camshaft and a position sensor for sensing the position of the camshaft. The method includes, for each detected tooth edge: computing a time signature of the detected edge; comparing the time signature of the detected edge with a set of theoretical signatures of edges of the target including a theoretical signature for each edge of the target, the comparison being implemented through a tolerance; and generating a synchronization or synchronization fault signal as a function of the result of the comparison. When the engine speed drops below a predetermined threshold, the tolerance adopted for comparing the time signature of a detected edge with the theoretical signature of an edge of the target is reduced in relation to the tolerance adopted for the same comparison before the engine speed drops below the threshold.

17 Claims, 5 Drawing Sheets

(56) References Cited

U.S. PATENT DOCUMENTS

| | | | | |
|---|---|---|---|---|
| 7,661,297 | B2 | 2/2010 | Steinruecken et al. | |
| 9,915,586 | B2 | 3/2018 | Hou | |
| 2007/0033995 | A1 | 2/2007 | Namari et al. | |
| 2008/0172160 | A1* | 7/2008 | Jiang | F01L 1/022 701/51 |
| 2009/0287400 | A1* | 11/2009 | Pursifull | F02D 41/009 701/113 |
| 2013/0151194 | A1* | 6/2013 | Hawken | F02D 41/222 702/151 |
| 2015/0020581 | A1* | 1/2015 | Stuckert | G01D 5/147 73/114.27 |

OTHER PUBLICATIONS

Written Opinion of the ISA for PCT/EP2019/076005 dated Nov. 19, 2019, 7 pages.

* cited by examiner

SYNCHRONISATION METHOD ROBUST TO ENGINE STALLING

CROSS-REFERENCE TO RELATED APPLICATIONS

This application is the U.S. national phase of International Application No. PCT/EP2019/076005 filed Sep. 26, 2019 which designated the U.S. and claims priority to FR 1858886 filed Sep. 27, 2018, the entire contents of each of which are hereby incorporated by reference.

FIELD OF THE INVENTION

The invention relates to a method for synchronizing an internal combustion engine based on the detection of the rising or falling edges of the teeth of a camshaft target, in order to determine the position of the engine.

The invention is particularly adapted to the implementation of a synchronization method that is effective against the stalling phases of the engine.

PRIOR ART

In order to determine the position of an internal combustion engine within the engine cycle, determining both the position of the engine crankshaft and of at least one engine camshaft is known.

To this end, at least two targets in the form of toothed wheels are securely mounted, respectively on the crankshaft and on a camshaft, and a respective sensor detects the edges of the teeth, respectively of each target, during the rotation of the crankshaft and of the camshaft. The detected data are subsequently processed in order to deduce the position of the engine.

With respect to the camshaft, it is the subject of a specific synchronization method that aims to identify each edge of the target detected by the sensor in order to deduce information therefrom that relates to the speed (engine speed in revolutions per minute) and the position of the engine, which information subsequently can be compared with the data relating to the position of the crankshaft in order to complete and/or correct said data.

This synchronization method is only performed by taking into account the information detected from the position of the camshaft target, i.e. without the data relating to the crankshaft, to allow the engine to operate in degraded mode if the crankshaft is faulty.

A conventionally implemented synchronization method involves determining, for each tooth edge of the target of the camshaft detected by the sensor, a time signature of this tooth edge, and comparing this signature with precomputed theoretical signatures of each edge of the target, through the consideration of a tolerance with respect to the value of the theoretical signature.

If the comparison does not result in any correspondence, the synchronization is not performed.

If the comparison results in a single correspondence, the synchronization is performed and the detected edge is identified as being that for which the theoretical signature corresponds to the time signature of the detected edge.

Finally, if the comparison results in several correspondences, the method is repeated for the following edge in order to refine the correspondence.

However, this type of synchronization method is not effective against all the situations experienced by the engines.

A first example is that of a reverse rotation of the engine, which occurs, for example, when the vehicle reverses with a gear engaged (for example, on a slope).

In this case, the signal measured by the sensor of the camshaft target can resemble a signal that would be measured if the vehicle advanced, and it can result in an erroneous identification of an edge of the camshaft target.

This is the case, for example, in FIG. 1*a*, which at the top shows a curve of the engine speed as a function of time (which is negative in this case) and at the bottom shows the progress of the edges of the camshaft target in front of the sensor, with the crosses corresponding to edges identified during the implementation of the synchronization algorithm. The synchronization algorithm is configured to only detect a forward progression. However, in a first zone A1, about twenty consecutive false detections have been observed during the reverse rotation, and, in a second zone A2, about twenty other consecutive false detections have been observed, each time corresponding to a forward rotation, whereas in reality the engine is in reverse rotation.

In other words, in these zones a progression of the camshaft as a forward rotation is detected in error.

In this case, the information provided by the synchronization algorithm does not match the data originating from the analysis of the position of the crankshaft target, which can generate a fault in the engine computer or the undue detection of a fault in determining the position of the crankshaft.

In a case whereby the analysis of the position of the crankshaft also would be erroneous, the engine would operate in degraded mode only based on the signals of the camshaft. In this case, if a rotation is detected in error, an injection of fuel can be authorized and can damage the engine.

Another example is that of engine stalling, i.e. a phase close to engine shutdown where the engine performs multiple bounce-backs in one direction then the other before stopping.

The successive bounce-backs in this case can lead to, via the synchronization algorithm, the detection of edges very close to the camshaft target, and can give an impression of very high engine speed if the bounce-backs are not detected. The speed determined by the synchronization algorithm is then significantly different from the engine speed, which can be detected as compromising the safety of the vehicle and of its driver. The computer that computes the engine speed then can be considered to be defective, which can generate a breakdown involving the replacement of the engine computer.

FIG. 1*b* shows a case of engine speed bounce-back accompanied by false detections of the position of the crankshaft. The top of FIG. 1*b* shows the engine speed, which, as can be seen, is alternatively negative and positive due to the bounce-back.

The bottom of FIG. 1*b* shows a zone of four false detections of edges of the camshaft target. These detections occur while the engine is in a reverse rotation phase associated with the bounce-back. Once again, this false detection can generate a breakdown of the engine computer.

DISCLOSURE OF THE INVENTION

In view of the above, the aim of the invention is to at least partly overcome the disadvantages of the prior art. In particular, an aim of the invention is to propose a synchronization method that is effective against a case of engine stalling.

To this end, the aim of the invention is a method for synchronizing an internal combustion engine comprising:

at least one camshaft, on which a target is mounted in the form of a toothed wheel, each tooth comprising a rising edge and a falling edge;

a position sensor for sensing the position of the camshaft, adapted to detect each rising or falling edge of a tooth of the target; and a unit for processing data generated by the sensor;

the synchronization method being implemented by the processing unit and comprising, for each detected tooth edge, the implementation of the following steps:

computing a time signature of the detected edge;

comparing the time signature of the detected edge with a set of theoretical signatures of edges of the target of the same rising or falling type as the detected edge, the comparison being implemented through a tolerance; and generating a synchronization or synchronization fault signal as a function of the result of the comparison, the synchronization method being characterized in that, when the engine speed drops below a predetermined threshold, the tolerance adopted for comparing the time signature of a detected edge with the theoretical signature of an edge of the target is reduced in relation to the tolerance adopted for the same comparison before the engine speed drops below said threshold.

In one embodiment, each theoretical signature is associated with a range of tolerance values defined as follows:

$$\left[\frac{\tau_{th}(n)}{k};\ \tau_{th}(n)*k\right]$$

where n is an index of the considered edge, $\tau_{th}(n)$ is the theoretical signature of the index edge n and k is a tolerance parameter that is strictly greater than 1, and the comparison of the time signature of a detected edge with a theoretical signature is implemented by determining whether the value of the time signature of the detected edge is included in the range of tolerance values associated with the theoretical signature.

Advantageously, the reduced tolerance is determined by a tolerance parameter k' below the tolerance parameter k associated with the initial range of tolerance values, and preferably less than 30 to 50% of the value of the tolerance parameter k.

The engine speed can be determined by the processing unit based on information supplied by the detector when a synchronization is performed.

In one embodiment, the method further comprises, when the engine speed drops below a predetermined threshold, triggering a timer, and the range of tolerance values associated with each theoretical signature is reset to the corresponding initial range of tolerance values when the timer has elapsed and the engine speed is once again above the predetermined threshold, or when a synchronization fault signal is generated.

In one embodiment:

a synchronization signal is generated if the time signature of the detected edge corresponds to the theoretical signature of a single edge of the target;

a synchronization fault signal is generated if the time signature of the detected edge does not correspond to any theoretical signature of the edges of the target with which it is compared; and a synchronization fault signal is generated if a plurality of candidate edges corresponds to the detected edge n and, during the detection of a following edge n+1, only the theoretical signatures of the edges that follow the candidate edges that would correspond to the detected edge n are compared with the time signature of the following edge.

Advantageously, but optionally, the step of generating a synchronization or synchronization fault signal is also performed as a function of a preceding synchronization or synchronization fault signal transmitted by the processing unit.

For example, in the event of a loss of synchronization, the processing unit can be adapted to only transmit the next synchronization signal in the event of successive individual correspondences, a predetermined number N of times, between the time signatures of the following detected edges and the theoretical signatures of the edges of the target with which said time signatures of the following detected edges are compared. The number N is preferably strictly greater than 1, preferably equal to the number of edges of the target.

Preferably, the threshold engine speed is less than or equal to 600 revolutions per minute.

A further aim of the invention is a computer program product, comprising code instructions for implementing the synchronization method according to the previous description, when it is implemented by a computer adapted to implement the method described above.

A further aim of the invention is an internal combustion engine comprising:

at least one camshaft, on which a target is mounted in the form of a toothed wheel, each tooth comprising a rising edge and a falling edge;

a position sensor for sensing the position of the camshaft, adapted to detect each rising or falling edge of a tooth of the target; and a processing unit for processing signals from the detector, configured to implement the synchronization method according to the previous description.

The proposed synchronization method makes provision for reducing the range of tolerances associated with a theoretical signature of an edge of the camshaft target when the engine speed drops below a predetermined threshold.

Indeed, stalling occurs in the phase of stopping the engine from a normal operating phase, i.e. when the engine speed decreases. Reducing the range of tolerances therefore allows the risks of erroneous synchronization to be reduced during stalling.

Furthermore, this reduced tolerance range is advantageously implemented during a time period triggered from the moment at which the engine speed drops below the predetermined threshold, or up to a loss of synchronization, corresponding to effective stalling of the engine. Afterwards, the tolerance is reset to its initial value to allow effective resynchronization when restarting the engine. This therefore ensures that in any case the engine leaves a stalling situation or a low speed situation before resetting the tolerance to its initial value. Indeed, as the synchronization is performed by identifying edges by elimination, the edges for which the signatures are outside tolerances are eliminated and having a higher tolerance makes the synchronization more effective. In summary, a reduced tolerance allows a loss of effective synchronization, and an enhanced tolerance allows an effective synchronization (or resynchronization).

Finally, advantageously several identifications of edges are necessary before confirming the resynchronization to avoid an erroneous synchronization when the tolerance range is reset to its initial value.

BRIEF DESCRIPTION OF THE DRAWINGS

Further features, aims and advantages of the invention will become apparent from the following description, which is purely illustrative and non-limiting, and which must be read with reference to the appended figures, in which.

DETAILED DESCRIPTION OF EMBODIMENTS OF THE INVENTION

Figure 1A:
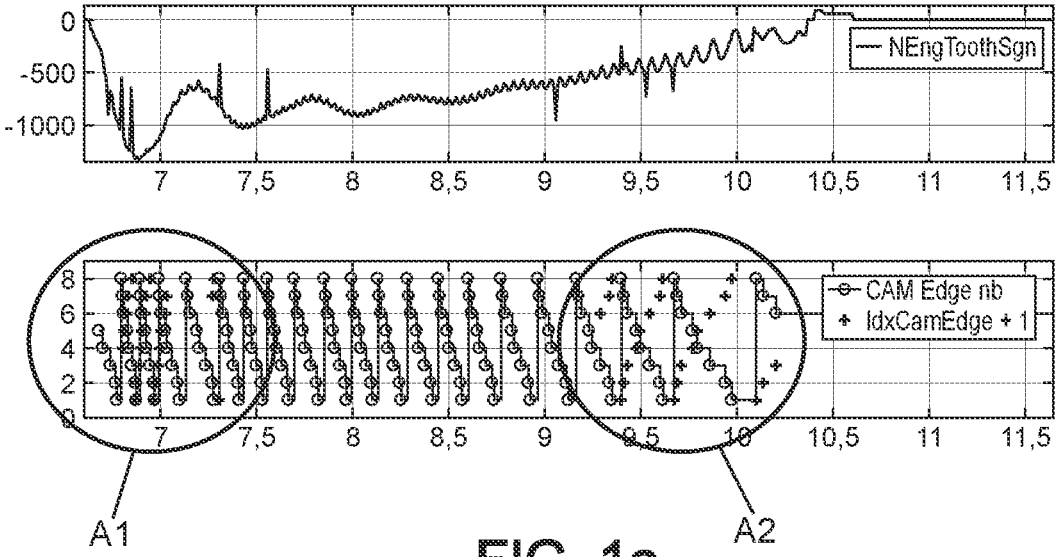
FIG. 1*a*, already described, shows a case of an error of a synchronization algorithm of the prior art in the event of reverse rotation of the engine.
Figure 1B:
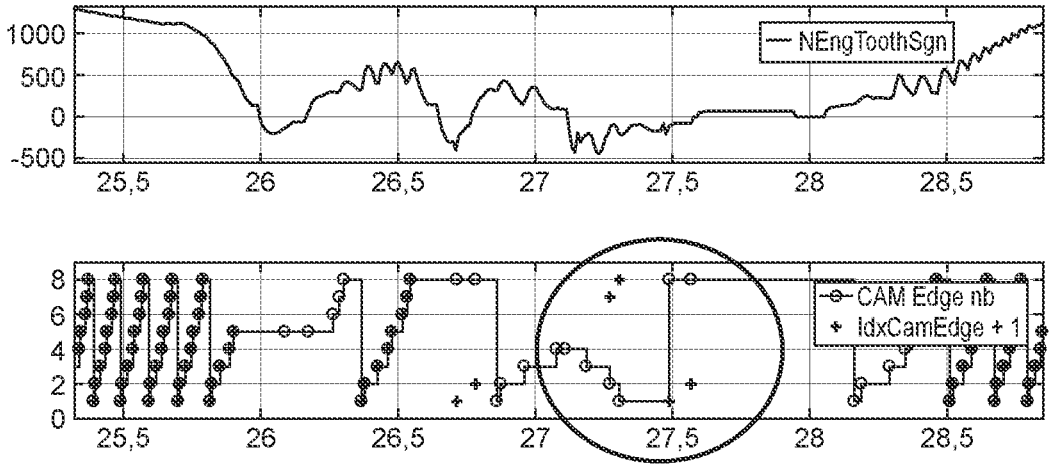
FIG. 1*b*, also already described, shows a case of an error of a synchronization algorithm of the prior art in the event of engine stalling.
Figure 2A:
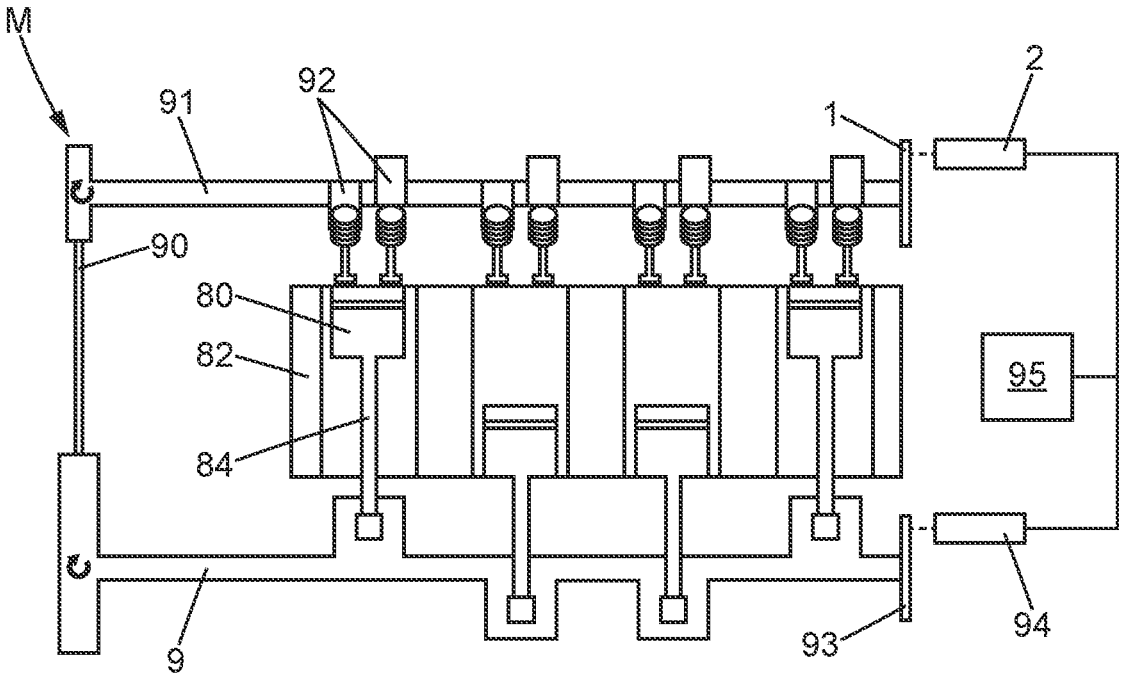
FIG. 2*a* schematically shows an example of an internal combustion engine, in which the synchronization algorithm can be implemented.

FIG. 2*a* schematically shows an internal combustion engine M comprising a set of movable pistons 80 moving in respective cylinders 82 between a top dead centre and a bottom dead centre, the engine M also comprising a crankshaft 9 driven by the movement of the pistons in the cylinders by means of respective connecting rods 84.

The crankshaft rotates, by means of a timing belt 90, at least one camshaft 91, the rotation of which successively causes the intake and exhaust valves 92 to open and close.

In one embodiment (not shown), the engine M can comprise two camshafts 91 comprising a camshaft, called intake camshaft, the rotation of which allows the intake valves to be opened and closed, and a camshaft, called exhaust camshaft, the rotation of which allows the exhaust valves to be opened and closed.

The crankshaft 9 comprises a toothed wheel 93 comprising a set of teeth evenly distributed over its circumference. A crankshaft angular position sensor 94 is positioned facing the toothed wheel 93 and is adapted to detect the passage of each tooth of the wheel and to deduce an angular position of the crankshaft therefrom.

Figure 2B:
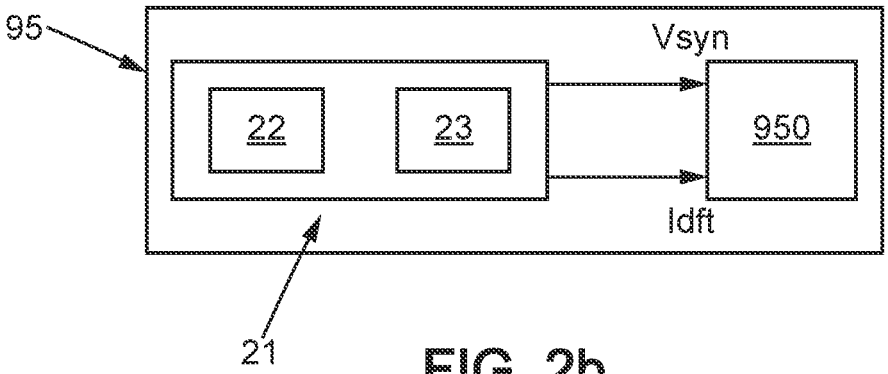
FIG. 2*b* schematically shows an engine computer.
Figure 2C:
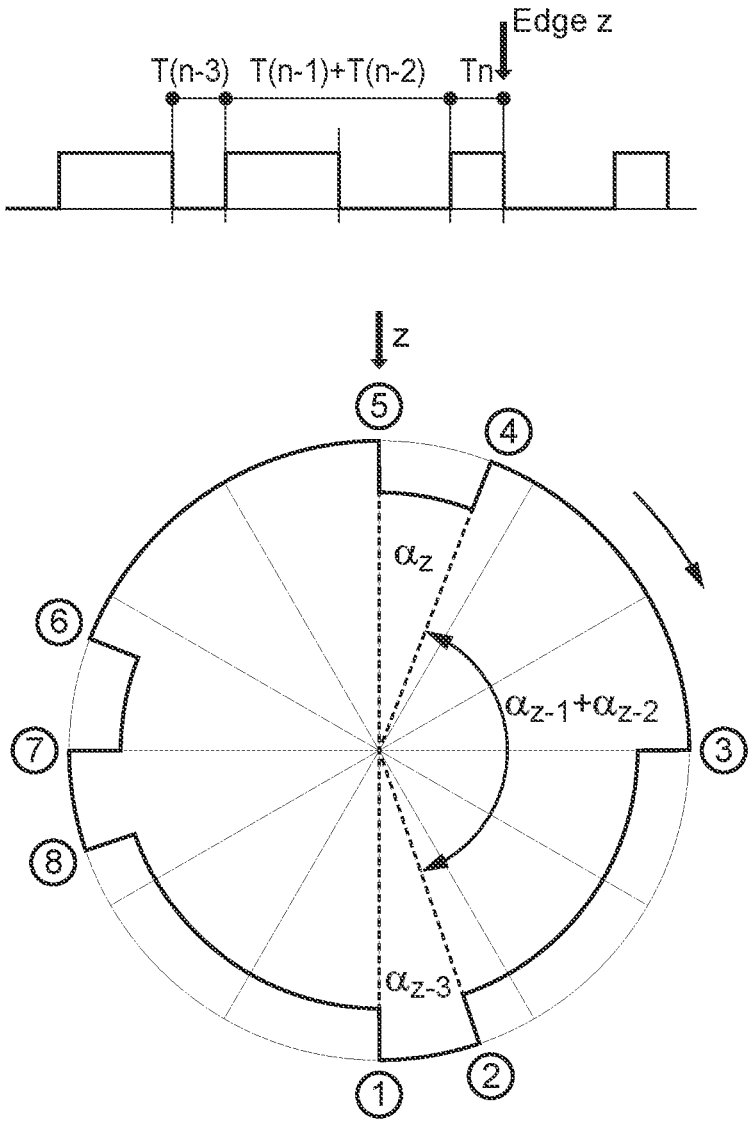
FIG. 2*c* shows an example of a camshaft target.

A target in the form of a toothed wheel 1 is mounted on the camshaft 91 or on each camshaft, an example of which target is shown in FIG. 2*c*. The target 1 comprises a set of teeth distributed over its periphery, with each tooth comprising a rising edge and a falling edge. The teeth of the target are advantageously uneven to allow the individual identification of each edge from among the set of edges of the target.

A sensor 2 for sensing the position of the camshaft (for example, of the Hall effect cell, magneto-resistive cell type, etc.) is positioned in front of the toothed wheel and is adapted for detecting each rising or falling edge of a tooth of the target.

With reference to FIG. 2*b*, the engine M also comprises an engine computer 95 comprising a processing unit 21 comprising, for example, a processor 22 or a microcontroller and a memory 23, the processing unit being configured to implement, on the basis of the raw signals of rising or falling edges detected by the sensor 2, or optionally of signals preprocessed by the sensor (in the case of sensors called active sensors), a synchronization method that will be described in further detail hereafter, and for which the code instructions for its execution are stored in the memory 23.

In order to implement the synchronization method, the processing unit 21 is advantageously configured to generate, based on the data from the detector, an external synchronization variable Vsyn, which can assume a value indicating a synchronization (Vsyn=Synok) and a second value indicating a synchronization fault (Vsyn=Wtsyn). The synchronization variable is set, during engine start up, to the value Wtsyn indicating a synchronization fault.

An external variable is understood to be a variable intended to be transmitted by the processing unit to other components or functional blocks 950 of the engine computer 95 for implementing methods requiring knowledge of the position of the camshaft, for example, the injection of fuel, the ignition, the variable distribution, etc. On the contrary, an internal variable will be subsequently called a variable that is only used in an algorithm executed by the processing unit and that is not transmitted to the other blocks of the engine computer.

The processing unit 21 also generates another external variable Idft representing the edge of the target that has been identified as corresponding to the edge detected by the detector.

The engine computer 95 advantageously comprises other processing modules 950 adapted for receiving the angular position signals of the crankshaft 9, as well as the external variables generated by the processing unit 21, and to deduce therefrom a state of the engine cycle at each instant and to implement control methods, for example, injection and ignition of the fuel.

Synchronization Method

Figure 3:
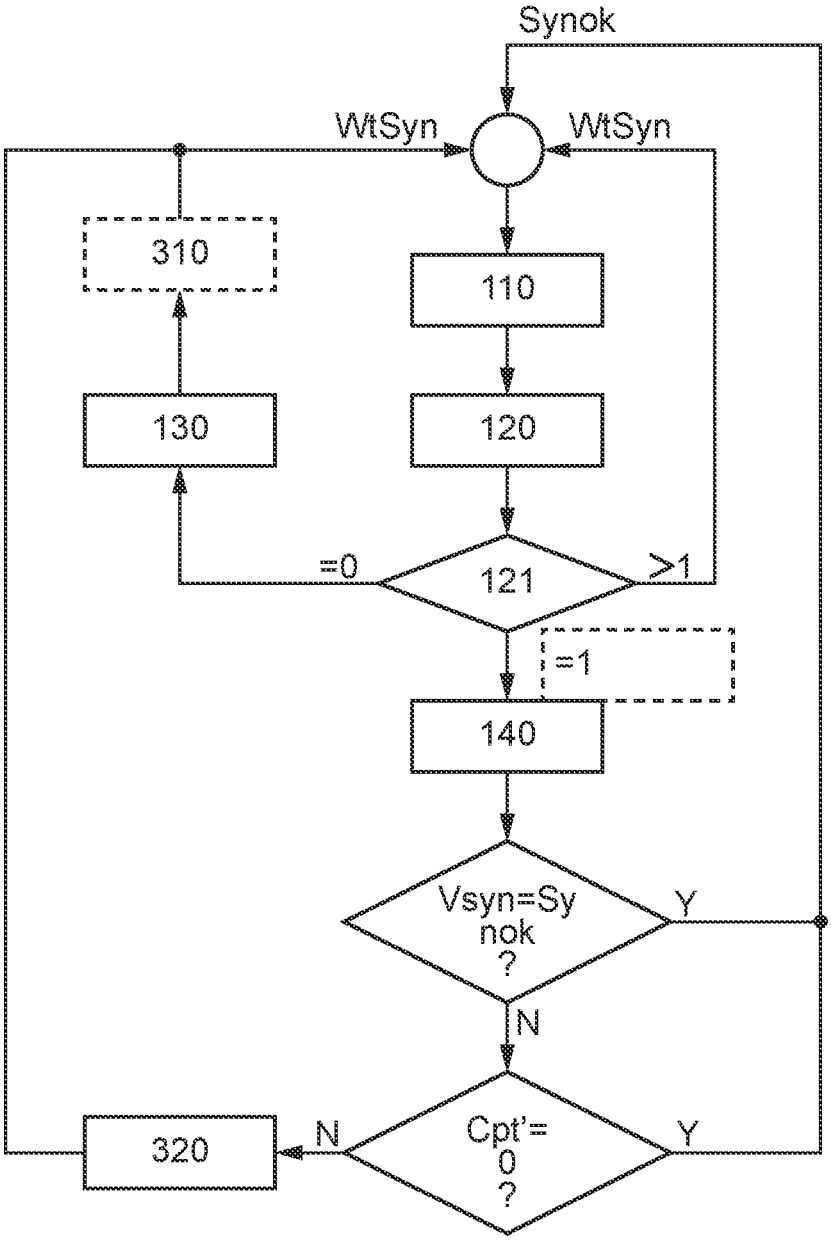
FIG. 3 schematically shows the main steps of the synchronization method according to one embodiment of the invention.
Figure 4:
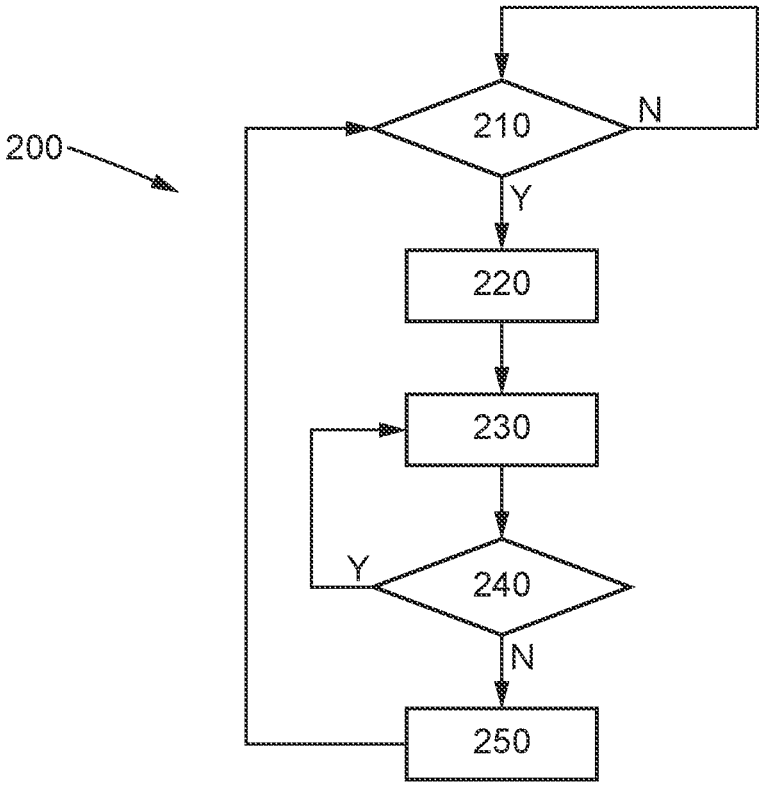
FIG. 4 schematically shows the implementation of the method according to one embodiment of the invention in the form of a flow chart.

With reference to FIGS. 3 and 4, a synchronization method will now be described that is implemented by the processing unit of the position sensor for sensing the position of a camshaft, upon each detection of a tooth edge by the detector.

During a first step 110, a time signature of the edge is computed.

FIG. 2*c* shows an example of a camshaft target and at the top it shows the corresponding signal generated by the detector. The normal direction of rotation of the target is indicated by the arrow. In the upper part of the figure, the detection of a rising edge of the target corresponds to a falling edge of the electrical signal.

In one embodiment, the time signature of a detected edge is defined by:

for the second and the third detected edge:

$$\tau_R(n) = \frac{T_n}{T_{n-1}}$$

where n is the index of a detected edge and $T_n$ is the duration of the tooth (or of the hollow) preceding the edge n, i.e. the elapsed time between the detection of the edge n−1 and the detection of the edge n.

In this embodiment, the time signature can be computed from the third detected edge.

In an alternative embodiment, the time signature of a detected edge is defined by:

$$\tau_R(n) = \frac{T_n + T_{n-3}}{T_{n-1} + T_{n-2}}$$

In this embodiment, the time signature can only be computed from the fifth detected edge.

The selection between these two embodiments is set for a given engine and depends on the number of edges on the target and/or on the shape of the teeth. For example, the first method is preferably used if the target comprises a few teeth or if several teeth are identical. The second method is used for the other cases, since it is more effective in cases of acceleration and deceleration.

During a step 120, the time signature of the detected edge is compared to a theoretical signature, precomputed and recorded in the memory 23, of at least one edge of the target of the same type as the detected edge. Advantageously, during a first iteration of step 120, the time signature of the detected edge is compared to the theoretical signatures of all the edges of the target of the same type as the detected edge. As described in further detail hereafter, during the following iterations of step 120, this comparison can only occur for some of the edges of the target.

As previously indicated, the teeth of the target are advantageously uneven so that the theoretical signature of an edge can allow the edge to be identified. The theoretical signature of an edge is not necessarily unique, but identification can be possible by adding the type of edge (rising or falling) and optionally by also adding a constraint on the sequence. For example, two theoretical signatures can be found with the same value but corresponding to two different types of edges, so that a single theoretical signature does not correspond to a detected edge.

According to another embodiment, there can be two theoretical signatures with the same value, but followed (for the following edge, for a considered direction of rotation) by two different theoretical signatures. It is then possible to identify the edge by elimination.

In a first embodiment, the theoretical signature is defined by:

$$\tau_{th}(n) = \frac{\alpha_n}{\alpha_{n-1}}$$

where $\alpha_n$ is the angle between the index edge and the previous edge (some angles are shown in FIG. 2*c* considering an edge z). The edges preceding the considered edge are not the same depending on whether the target is considered to be in forward rotation or in reverse rotation, which explains the computation of one theoretical signature for each direction of rotation.

The theoretical signature of an edge of the target in reverse rotation also can be seen as the theoretical signature of the same edge of the reversed target (or seen in a mirror) in forward rotation.

This embodiment is retained if the time signature of an edge is computed according to the first equation indicated above:

$$\tau_R(n) = \frac{T_n}{T_{n-1}}$$

As an alternative embodiment, the theoretical signature of an edge is computed using the following equation:

$$\tau_{th}(n) = \frac{\alpha_n + \alpha_{n-3}}{\alpha_{n-1} + \alpha_{n-2}}$$

This alternative embodiment is implemented in the event that the time signature is only computed from the fifth detected edge as follows:

$$\tau_R(n) = \frac{T_n + T_{n-3}}{T_{n-1} + T_{n-2}}$$

Thus, a theoretical signature of the edge, as well as the type of edge, either rising or descending, is stored in the memory 23 for each edge.

Advantageously, in order to compare the time signature of the detected edge with the theoretical signatures of the edges of the same type of the target, a tolerance range is provided for each theoretical signature.

This tolerance range is defined, for each theoretical signature of an edge $\tau_{th}(n)$ by:

$$\left[\frac{\tau_{th}(n)}{k}, \tau_{th}(n) \cdot k\right],$$

where k is a tolerance factor that is strictly greater than 1, advantageously ranging between 2 and 3, for example, ranging between 2 and 2.5.

The comparison of the time signature of the detected edge with a theoretical signature of an edge is performed by determining whether the time signature of the detected edge is included in the tolerance range.

FIG. 3 shows a step 121 for distinguishing the series of steps as a function of the number of edges of the target corresponding to the detected edge, i.e. for which the tolerance range associated with the theoretical signature contains the time signature of the edge. In FIG. 3, "Y" means yes and "N" means no.

If, on completion of step 120, the detected edge does not correspond to any theoretical signature of an edge of the target of the same type, i.e. the time signature of the detected edge is not included in any tolerance range of the theoretical signatures of the edges of the target of the same rising or falling type, the method comprises a step 130 where the detected edge has not been identified, and the external synchronization variable assumes the value WtSyn. The method subsequently resumes at step 110 for the following detected edge. As an alternative embodiment, the method may only resume at step 110 after the detection of three or five edges, depending on the mode for computing time and theoretical signatures, so as not to retain the preceding detection times for which no edge has been identified.

If, on completion of step 120, the detected edge corresponds to a single edge of the target of the same type (i.e. the time signature of the detected edge is included in the tolerance range of the theoretical signature of an edge of the same type), the method comprises a step 140 where the detected edge is identified as that for which the theoretical signature corresponds to the time signature of the edge, and the external synchronization variable assumes the first value Synok. The processing unit also returns a signal identifying the detected edge. The method subsequently resumes at step 110 for the following detected edge. In a particular embodiment, during the following iteration of step 120, the time signature of the detected edge may only be compared with a single theoretical signature, which is that of the edge following that which was previously identified. In the absence of correspondence, the external synchronization variable assumes the value WtSyn (step 130).

If, on completion of step 120, the detected edge corresponds to a plurality of candidate edges of the target, i.e. the time signature of the detected edge is included in the tolerance range of a plurality of theoretical signatures of edges, the external synchronization variable assumes the second value WtSyn and steps 110 and 120 are implemented again for the following edge, by only using, for the comparison of step 120, the edges that immediately follow the candidate edges. Steps 110 and 120 can be repeated until a unique correspondence 140 has occurred, or until no correspondence 130 has occurred, in which case steps 110 and 120 are again implemented normally from the following edge.

Advantageously, in order to be able to make the synchronization method effective against an engine stalling phase, the implementation of step 120 of comparing the time signature of the detected edge with the theoretical signatures of the edges of the target takes into account the engine speed. Indeed, an engine stalling phase generally occurs shortly before the engine stops, and therefore generally during a reduction in the engine speed.

Consequently, at the same time as the synchronization method described above is implemented, the engine speed is monitored so that, if the engine speed drops below a predetermined threshold, the comparison of the time signature of an edge detected with the theoretical signatures of all the edges of the target, is advantageously implemented with a reduced tolerance range compared to the tolerance range described above in the standard case.

To this end, advantageously in the memory of the processing unit, each edge is associated with a tolerance range, called standard range, and a tolerance range, called reduced range, with either one being selected as a function of the development of the engine speed.

For the reduced tolerance range, the tolerance factor k' is strictly less than the tolerance factor k introduced above. For example, the tolerance factor k' is advantageously 30 to 50% less than the tolerance factor k of the standard tolerance range.

The engine speed threshold, below which the tolerance range is reduced, is less than the idling speed for the considered engine. Advantageously, it is less than or equal to 600 revolutions per minute.

FIG. 4 schematically shows the implementation of the monitoring of the engine speed 200 at the same time as the implementation of the synchronization method. In FIG. 4, Y means yes and N means no.

Advantageously, the engine speed information is obtained by the processing unit 21 during a synchronization phase, based on data relating to the position of the camshaft. Indeed, the progression speed of the edges of the camshaft allows a rotation speed, and therefore an engine speed, to be deduced therefrom.

A first step 210 involves determining whether the engine speed drops below the predetermined threshold.

If so, during a step 230, the tolerance factor applied to the tolerance range of the theoretical signature of an edge becomes the tolerance factor k'.

Advantageously, a timer is also triggered during a step 220, so that the tolerance factor remains at the reduced level (k') until the timer has elapsed and the engine speed is again above the threshold, or until a loss of synchronization has effectively occurred (step 130). A step 240 of verifying these conditions is shown in FIG. 4. If these conditions are verified, then the tolerance factor again assumes the standard value (k) in step 250. Otherwise, the tolerance factor is kept at the reduced level (k').

The duration of the timer is advantageously determined during a preliminary calibration step (not shown), so as to exceed the average duration of a stalling phase from the moment at which the engine speed drops below the predetermined threshold.

This timer allows a reduced tolerance state to be maintained throughout the entire stalling period to avoid incorrect synchronization during this period.

With further reference to FIG. 3, in one embodiment, once a loss of synchronization has occurred (i.e. when the variable Vsyn has transitioned from the value SynOk to WtSyn), the recovery of the synchronization is only performed when a sufficient number of consecutive edges has been identified (i.e. that a single correspondence 140 has been found).

To this end, a counter cpt is installed, for example, at an initial value N, and, during the implementation of the synchronization method on the following edges, in the event that on completion of this step 120 of comparing between the time signature of the detected edge and the theoretical signatures of the edges of the target, a single edge of the target corresponds to the detected edge (140), the change of value of the external synchronization variable Vsyn depends on the value of the counter.

If the counter has a non-zero value, then it is decremented during a step 320, but the external synchronization variable retains the synchronization fault value WtSyn.

It only again assumes the synchronization value Synok (step 140) when the value of the counter becomes zero, i.e. only when a plurality of edges has been successively detected. The counter is reset (not shown) when the external synchronization variable assumes the value Synok or when no edge is identified (step 130).

The initial value N of the counter is greater than or equal to 1, preferably strictly greater than 1, for example, equal to the number of edges of the target. This counter is used to validate that the engine has effectively exited a stalling phase, before confirming the synchronization.

As an alternative embodiment, the counter cpt can be set to 0 and be incremented until it reaches the maximum value N leading to the recovery of the synchronization.

The invention claimed is:

1. A method implemented by a processing unit (21) for synchronizing an internal combustion engine (M) equipped with at least one camshaft (91) on which a target (1) is mounted, the target formed as a toothed wheel comprising a plurality of teeth, the internal combustion engine (M) also equipped with a position sensor (2) that senses a position of the camshaft, the position sensor (2) configured to detect an edge of each tooth of the teeth of the target, the processing unit (21) configured to process data generated by the position sensor (20) of the edges of the teeth detected by the position sensor, the synchronization method comprising, for each detection of one of the edges of the target successively detected by the position sensor (2) and each being of a type of one of a rising edge and a falling edge, carrying out steps of:

receiving data from the position sensor (20) of a detected edge;

computing (110) a time signature of the detected edge;

comparing (120) the computed time signature of the detected edge with a set of theoretical time signatures of edges of the target of a same type of one of a rising edge and a falling edge as that of the detected edge, a result of the comparing step depending on one of a first tolerance and a reduced second tolerance that is lower than the first tolerance, wherein the comparing step applies the first tolerance when a speed of the engine is higher than a predetermined threshold, and the comparing step applies the reduced second tolerance when the engine speed drops below said predetermined threshold; and generating one of a synchronization signal and a synchronization fault signal as a function of the result of the comparing step.

2. The synchronization method as claimed in claim 1, wherein each theoretical signature is associated with a first range of tolerance values defined as follows:

$$\left[\frac{\tau_{th}(n)}{k};\ \tau_{th}(n)*k\right]$$

where n is an index of the detected edge under consideration, $\tau_{th}(n)$ is a theoretical signature of an index edge n, and k is a first tolerance parameter that is greater than 1, wherein, when the first tolerance is applied, the comparing step (120) is implemented by determining whether a value of the time signature of the detected edge is included in the first range of tolerance values associated with the theoretical signature, and wherein, when the reduced second tolerance is applied, a reduced second range of tolerance values is applied by the comparing step, said reduced second range of tolerance values defined as:

$$\left[\frac{\tau_{th}(n)}{k};\ \tau_{th}(n)*k'\right]$$

where k' is a second tolerance parameter smaller than the first tolerance parameter k.

3. The synchronization method as claimed in claim 1, wherein the engine speed is determined by the processing unit (21) based on information supplied by the position sensor.

4. The synchronization method as claimed in claim 1, further comprising, when the engine speed drops below the predetermined threshold:

triggering (220) a timer; and subsequently, when either of a synchronization fault signal is generated, or both the timer has elapsed and the engine speed is determined to be above the predetermined threshold, a range of tolerance values applied by the comparing step is reset from the reduced second range of tolerance values to the first range of tolerance values.

5. The synchronization method as claimed in claim 1, wherein:

a synchronization signal is generated when the time signature of the detected edge corresponds to the theoretical signature of a single edge of the target;

a synchronization fault signal is generated when the time signature of the detected edge does not correspond to any theoretical signature of the edges of the target with which the detected edge is compared; and a synchronization fault signal is generated when a plurality of candidate edges corresponds to the detected edge n and, during detection of a following edge n+1, and only the theoretical signatures of edges that follow the candidate edges that would correspond to the detected edge n are compared with the time signature of the following edge.

6. The synchronization method as claimed in claim 1, wherein the generating step is also performed as a function of a previous synchronization or synchronization fault signal transmitted by the processing unit.

7. The synchronization method as claimed in claim 6, wherein, when a loss of synchronization occurs, the processing unit transmits only a next synchronization signal in the event of successive individual correspondences, a predetermined number N of times, between time signatures of following detected edges and theoretical signatures of edges of the target with which said time signatures of the following detected edges are compared.

8. The synchronization method as claimed in claim 7, wherein the predetermined number N is greater than 1.

9. The synchronization method as claimed in claim 1, wherein the predetermined threshold of the speed of the engine is less than or equal to 600 revolutions per minute.

10. A non-transitory computer-readable medium, on which is stored a computer program comprising code instructions that, upon execution by a computer (22), implement the synchronization method claimed in claim 1.

11. An internal combustion engine (M), comprising:

at least one camshaft (91), on which a target (1) is mounted in the form of a toothed wheel, each tooth comprising a rising edge and a falling edge;

a position sensor (2) that senses a position of the camshaft (91), the position sensor (2) configured to detect each rising or falling edge of a tooth of the target (1); and a processing unit (21) that processes signals from the position detector (20) of the detected edges, said processing unit configured to implement the synchronization method as claimed in claim 1.

12. The synchronization method as claimed in claim 2, wherein the second tolerance parameter k' is less than 30% of the first tolerance parameter k.

13. The synchronization method as claimed in claim 2, wherein the second tolerance parameter k' is less than 50% of the first tolerance parameter k.

14. The synchronization method as claimed in claim 2, further comprising, when the engine speed drops below the predetermined threshold:

triggering (220) a timer; and subsequently, when either of a synchronization fault signal is generated, or both the timer has elapsed and the engine speed is determined to be above the predetermined threshold, a range of tolerance values applied by the comparing step is reset from the reduced second range of tolerance values to the first range of tolerance values.

15. The synchronization method as claimed in claim 3, further comprising, when the engine speed drops below the predetermined threshold:

triggering (220) a timer; and subsequently, when either of a synchronization fault signal is generated, or both the timer has elapsed and the engine speed is determined to be above the predetermined threshold, a range of tolerance values applied by the comparing step is reset from the reduced second range of tolerance values to the first range of tolerance values.

16. The synchronization method as claimed in claim 2, wherein:

a synchronization signal is generated when the time signature of the detected edge corresponds to the theoretical signature of a single edge of the target;

a synchronization fault signal is generated when the time signature of the detected edge does not correspond to any theoretical signature of the edges of the target with which the detected edge is compared; and a synchronization fault signal is generated when a plurality of candidate edges corresponds to the detected edge n and, during detection of a following edge n+1, and only the theoretical signatures of edges that follow the candidate edges that would correspond to the detected edge n are compared with the time signature of the following edge.

17. The synchronization method as claimed in claim 7, wherein the predetermined number N is equal to the number of edges of the target.

* * * * *